US005195476A

United States Patent [19]

Schwarz

[11] Patent Number: 5,195,476

[45] Date of Patent: Mar. 23, 1993

[54] METHOD AND APPARATUS FOR PREVENTING WEAR IN AN INTERNAL COMBUSTION ENGINE

[76] Inventor: Irving L. Schwarz, 42 Nickerson Rd., Newton, Mass. 02167

[21] Appl. No.: 737,678

[22] Filed: Jul. 30, 1991

[51] Int. Cl.[5] ..... F02N 11/08

[52] U.S. Cl. ..... 123/179.5; 123/179.16; 123/196 S

[58] Field of Search ..... 123/179.1, 179.3, 179.5, 123/179.16, 179.17, 196 R, 196 S

[56] References Cited

U.S. PATENT DOCUMENTS

| | | | |
|---|---|---|---|
| 1,926,801 | 9/1933 | Christian | 123/196 S |
| 2,102,514 | 12/1937 | Clarkson | 123/196 S |
| 3,066,664 | 12/1962 | McNew et al. | 123/196 |
| 3,556,070 | 12/1971 | Holcomb | 123/196 |
| 3,583,525 | 6/1971 | Holcomb | 184/6 |
| 3,722,623 | 3/1973 | Waldecker | 184/6.3 |
| 3,842,937 | 10/1974 | Lippay et al. | 184/6.3 |
| 4,077,381 | 3/1978 | Firey | 123/179.16 |
| 4,112,910 | 9/1978 | Percy | 123/196 S |
| 4,157,744 | 6/1979 | Capriotti | 184/6.3 |
| 4,168,693 | 9/1979 | Harrison | 123/196 S |
| 4,502,431 | 3/1985 | Lulich | 123/179.1 |
| 4,524,734 | 6/1985 | Miller | 123/196 S |
| 4,703,727 | 11/1987 | Cannon | 123/196 S |
| 4,825,826 | 5/1989 | Andres | 123/196 S |
| 4,834,039 | 5/1989 | Apostolides | 123/196 S |
| 4,875,443 | 10/1989 | Sano et al. | 123/179.3 |
| 4,875,551 | 10/1989 | Lulich | 184/6.3 |
| 4,893,598 | 1/1990 | Stasiuk | 123/196 S |
| 4,936,272 | 6/1990 | Whitmore | 123/196 S |
| 4,940,114 | 7/1990 | Albrecht | 184/6.3 |
| 4,951,620 | 8/1990 | Staerzl | 123/179.5 |

FOREIGN PATENT DOCUMENTS

| | | | |
|---|---|---|---|
| 60-187766 | 9/1985 | Japan | 123/179.1 |

*Primary Examiner*—Andrew M. Dolinar
*Attorney, Agent, or Firm*—Wolf, Greenfield & Sacks

[57] ABSTRACT

An apparatus for preventing wear in an internal combustion engine having a starter motor, an oil pump, a fuel pump, and ignition elements and an electrical system for actuating the starter motor and oil pump, the apparatus including a delay element designed and constructed for preventing actuation of one or both of the fuel pump and spark plug while the starter motor and oil pump are actuated and until a predetermined conditions occurs, namely, the elapse of a predetermined time interval or pressure at the oil pump reaching a predetermined level. According to another aspect of the invention, a method for reducing wear in an internal combustion engine includes the steps of actuating the starter mechanism to initiate movement of the engine parts actuating the oil pump to circulate oil to the moving parts, and preventing combustion of fuel while the oil pump and starter mechanism are actuated and until either of the above-mentioned predetermined conditions occur.

23 Claims, 2 Drawing Sheets

METHOD AND APPARATUS FOR PREVENTING WEAR IN AN INTERNAL COMBUSTION ENGINE

FIELD OF THE INVENTION

This invention relates to internal combustion engines, and more particularly, to a method and apparatus for prelubricating the engine before start-up to reduce wear on the moving parts of the engine.

BACKGROUND OF THE INVENTION

Approximately one-half of the wear of a properly maintained internal combustion engine is attributable to starting the engine in an unlubricated condition. When an engine remains idle for a period of time, the engine oil drains from the movable parts of the engine, leaving them in a dry, unlubricated state. Subsequent firing of the engine causes the unlubricated surfaces to contact each other causing considerable frictional wear before the lubricating oil normally contained in the engine sump can be distributed throughout the engine by the engine oil pump.

One approach to this problem is to introduce chemical additives into the engine oil which cling to the walls of the cylinders and other movable parts after the engine is shut off. When the engine is next engaged, the cylinder walls, pistons and other parts have some lubrication to protect them against frictional wear.

Another approach is to provide a prelubrication system such as those disclosed in U.S. Pat. Nos. 3,066,664, McNew et al.; 3,583,525, Holcomb; 3,556,070, Holcomb; 3,722,623, Waldecker; 3,842,937, Lippay et al.; 4,112,910, Percy; 4,157,744, Capriotti; 4,168,693, Harrison; 4,524,734, Miller; 4,502,431, Lulich; 4,703,727, Cannon; 4,834,039, Apostolides; 4,825,826, Andres; 4,875,551, Lulich; 4,893,598, Stasiuk; 4,936,272, Whitmore; 4,940,114, Albrecht. Generally, these patents disclose supplementary oil pumping systems which inject oil into the engine prior to cranking and start-up. Although these references partially address the problem of prelubricating the engine, there are many undesirable drawbacks to such systems. For example, most prior art prelubricating systems do not utilize the existing engine oil pump but require an oil storage element, and/or a supplementary oil pump, in addition to the oil pump already present in the engine. These additional elements increase the complexity and costs of installation and maintenance of such a system, as well as the space requirements in an already cramped engine area. Consequently, the size, complexity, cost and problems associated with the installation and maintenance of such systems has prevented their widespread use in most vehicles, except for high performance boats and automobiles. It is estimated that approximately less than 1 in 10,000 automobiles have a engine prelubrication system.

In addition, most prior art prelubrication systems supply oil to the engine parts, prior to ignition, while the engine is not moving. As a result, "blind spots" occur where contacting metal surfaces were not penetrated by the injected oil. Such blind spots remain unlubricated at engine start-up and contribute to engine wear.

Accordingly, there exists a need for an engine prelubricating system which will reduce engine wear and will be simpler, less expensive, more space efficient, and more easily installed and maintained than prior art prelubrication systems.

It is, therefore, an object of the present invention to provide an engine wear prevention system which utilizes the existing engine oil system and oil pump and requires few additional elements to implement.

Another object of the present invention is to provide an engine wear prevention system which is inexpensive to both manufacture and install.

A further object of the present invention is to provide an engine wear prevention system which is simple in design and operation.

Yet another object of the present invention is to provide an engine wear prevention system which is easily installed in current and older automobiles.

A further object of the present invention is to provide an engine wear prevention system which can be easily manufactured in new automobiles.

Still a further object of the present invention is to provide an engine wear prevention system which eliminates blind spots in the prelubricating process, prior to engine firing.

SUMMARY OF THE INVENTION

The above and other objects are achieved in accordance with the present invention which, according to a first aspect, provides a kit comprising an apparatus for preventing wear in an internal combustion engine having a starter motor, an oil pump, a fuel pump, an ignition means, and an electrical system for actuating the starter motor and oil pump, the apparatus comprising a delay element designed and constructed for preventing actuation of one or both of the fuel pump and spark plug while the starter motor and oil pump are actuated and until a predetermined condition occurs.

According to a second aspect of the invention, a method for reducing wear in the firing chamber of an internal combustion engine having a piston means moving in the chamber at an initial lower cranking speed, the method comprising the step of providing a lubricating oil to the sliding surface formed between the piston and firing chamber when the piston means is moving at cranking speed while preventing firing or combustion of fuel in the chamber. The foregoing and other features, objects and advantages of the invention, will be more fully understood by reading the detailed description below in conjunction with the drawings.

DETAILED DESCRIPTION

The present invention provides a simple and inexpensive way of reducing wear in an internal combustion engine. Internal combustion engines include gasoline, diesel and rotary (Wankel) engines for the purposes of this description. The present invention is preferably implemented in an internal combustion engine having a plurality of movable parts such as pistons, cam shafts, etc., which require lubrication during relative movement to reduce wear. The engine further includes a starter mechanism for initiating movement within the engine and an oil supply system having an oil pump for circulating oil to the parts of the engine which have been set in motion by the starter mechanism. The engine further includes a fuel pump for supplying a combustible fuel to the engine and one or more spark plugs or ignition elements for igniting the combustible fuel within the engine. The engine further includes a source of electrical engergy, typically a battery, and an ignition system for selectively activating one or more of the starter mechanism, fuel pump, spark plugs and/or oil pump. The construction and arrangement of these elements is well known and within the scope of one reasonably skilled in the relevant art. Accordingly, a detailed description of these elements is beyond the scope of this invention and will not be provided hereinafter.

In accordance with the methods and apparatus of the present invention, the pre-existing battery and ignition system of the engine are utilized to activate the starter mechanism, causing movement of the parts within the engine, at a low rate, typically 300 rotations per minute (RPM). At the same time, the oil pump of the oil system in the engine is actuated, either by motion of the starter motor, or by the ignition system, in the case of an electric oil pump, causing oil to be forced onto the parts of the engine as they move. In addition, an invention delay system is provided for preventing combustion from occurring within the engine until either a predetermined period of time has passed or the oil pressure within the engine has reached a predetermined level. Combustion is prevented by the delay system which prevents either the fuel pump and/or spark plugs from being actuated by the battery until the desired predetermined condition occurs.

Figure 1:
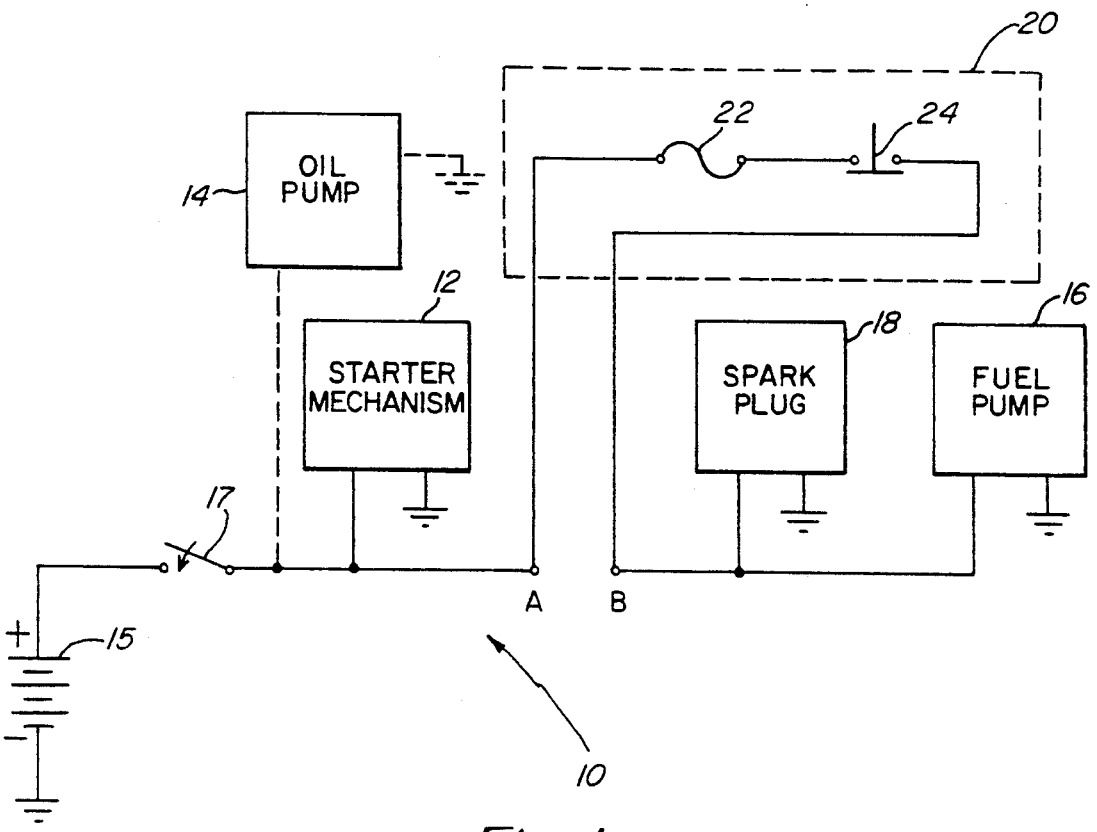
FIG. 1 is a block schematic diagram of an engine wear prevention system according to a first embodiment of the present invention.

Referring now to the drawings, and in particular FIG. 1, an apparatus for preventing wear in an integral combustion engine according to a first embodiment of the present invention is illustrated. Engine 10, shown here partially in a simplified schematic block diagram, comprises starter mechanism 12, oil pump 14, battery 15, ignition switch 17 and and spark plug 18. Battery 15 may be a conventional 12 volt DC car battery which supplies electrical energy to the other elements of the engine through appropriate cableing and fusing, which is not shown here for the sake of simplicity. Starter mechanism 12 may be a conventional electromechanical starter motor. Oil pump 14 may be a conventional mechanically driven oil pump which is actuated by the starter motor which causes the engine to turn over at a low rate when actuated. Alternately, oil pump 14 may be electrically coupled to battery 15 through ignition switch 17, as indicated by the dashed line in FIG. 1. Spark plug 18 comprises one or more conventional spark plugs and is operatively coupled to battery 15 through ignition switch 17 and/or delay system 20. Fuel pump 16 is an electrically actuated pump similar to that found in most automobiles and is operatively coupled to battery 15 through ignition switch 17 and delay system 20, as explained hereinafter.

Delay system 20, outlined by the dashed line, comprises a fuse 22 and switch 24 connected in series between fuel pump 16 and ignition switch 17. Fuse 22 may be a typical 20A fuse found in most automobiles. Switch 24 may be a push-button switch of the type having contact which are normally closed. Delay system 20 may be easily integrated into an automobile engine wiring system by replacing the pre-existing fuel pump and/or spark plug fuse with delay system 20. This may be accomplished by replacing the existing fuse with a dummy (open) fuse which is coupled to nodes A and B of FIG. 1.

To prelubricate the engine, and thereby reduce engine wear, the engine operator depresses switch 24 thereby opening its contacts and effectively disconnecting fuel pump 16 from battery 15. Ignition switch 17 is then closed allowing battery 15 to energize starter mechanism 12 and or oil pump 14. The starter mechanism 12 causes the engine to crank or turn over at a low rate, typically 300 RPM, activating the fuel pump, in the case of a mechanically driven fuel pump, and causing oil pressure to eventually reach normal operating levels within engine 10. As the engine turns over at a low rate, the oil pump circulates oil throughout the engine causing the parts to be lubricated as they move. Such lubrication of the engine parts while in motion prevents any "blind spots" from occurring and ensures that all contacting surfaces, particularly the pistons and cylinder walls, are adequately lubricated prior to firing.

Once oil pressure in the engine has reached normal operating levels or a predetermined timer interval has elapsed, the operator again depresses the switch 24 causing the switch contacts to close, thereby operativley coupling fuel pump 16 and spark plug 18 to battery 15. Upon actuation of the fuel pump, fuel will be supplied to the engine cylinders and combustion will occur. In this manner, when the engine begins to turn over at higher rates, the moving parts are well lubricated.

It will be obvious to those reasonably skilled in the art that fuel pump 16 and spark plug 18 may be disconnected from battery 15 at any number of points throughout the electrical system of the engine, while still obtaining the same results. The installation of delay system 20 at the fuse point of either spark plug 18 and/or fuel pump 16 is chosen for its easy access in existing automobiles or other vehicles. Delay system 20 as described above is a fail safe system. If the operator fails to open switch 24, the engine will start normally, although in an unlubricated condition.

Figure 2:
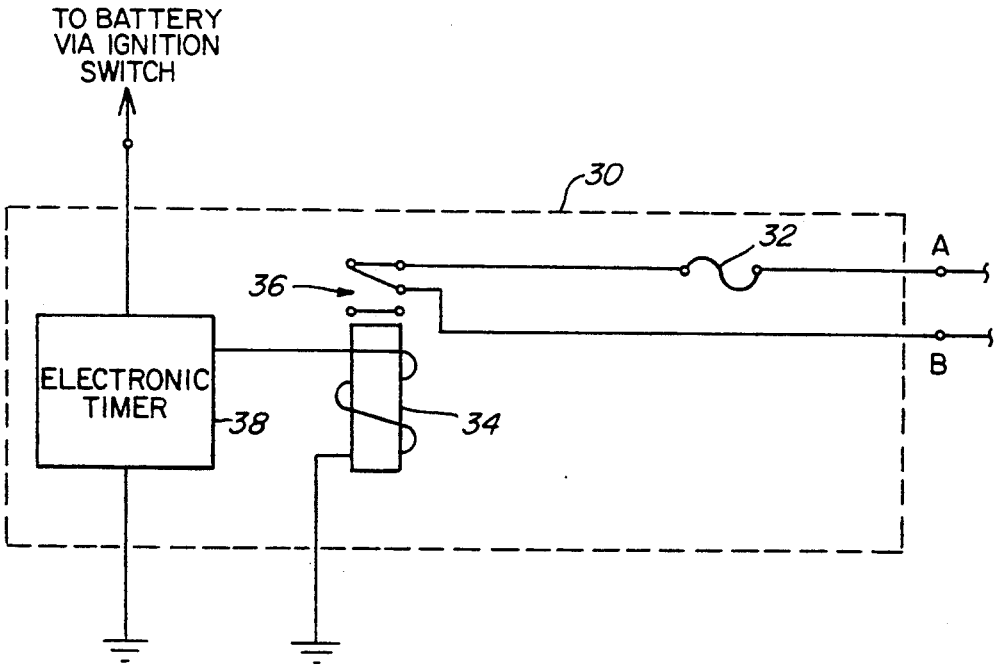
FIG. 2 is a schematic diagram of an engine wear prevention system in accordance with a second embodiment of the present invention.

A delay system 30 in accordance with a second embodiment of the present invention is illustrated in FIG. 2. Delay system 30 is connected to the nodes A-B of the circuit illustrated in FIG. 1. Delay system 30 comprises a fuse 32, relay coil 34, relay contact 36, and timer 38. As in delay system 20, the leads A-B of delay system 30 may be coupled to a dummy fuse which is inserted in place of the fuel pump fuse and/or spark plug fuse in the engine electrical system. In this manner, fuse 32 is coupled between battery 15 and one terminal of relay contact 36B, as indicated in FIG. 2. The other terminal of relay contact 36 is coupled to lead B as indicated. Relay contact 36 is normally in a closed position and is opened when activated by relay coil 34. One terminal of relay coil 34 is coupled to electrical ground. The other terminal of relay coil 34 is coupled to the output of timer 38, as indicated. Timer 38 is an integrated circuit timer. A timer suitable for use in the present invention is Model No. 555 available from Radio Shack, Tandy Corp., Dallas, Tex. Timer 38 receives input voltage from ignition switch 17 and supplies voltage to relay coil 34. Alternately, timer 38 may receive an input voltage from the starter mechanism 12 or may have its input coupled to the same circuit node at which an actuating voltage is supplied to starter mechanism 12, if other than one of the contacts of ignition switch 17.

Delay system 30 of the second embodiment works automatically without any manual interaction from the operator of the engine. Upon closing ignition switch 17 or alternately, actuation of starter mechanism 12, voltage is supplied to an input pin of timer 38 which is in turn supplies voltage to one end of relay coil 34, energizing the coil. Relay contacts 36, which are normally in a closed position are opened by coil 34, causing the fuel pump 16 and/or spark plug 18 to disengage from battery 15. Relay contact 36 remains open until coil 34 is deactivated by timer 38.

A variable resistor and capacitor (not shown) associated with timer 38 determine the duration of delay before timer 38 deactivates relay coil 34. In the present invention, a delay of approximately five seconds after ignition switch 17 activates starter motor 12 and oil pump 14 is suitable for ensuring adequate prelubrication of the engine. Once the delay interval has elapsed, relay coil 34 is deactivated causing relay contact 36 to close, and effectively coupling fuel pump 16 and/or spark plug 18 to battery 15. During the delay interval following actuation of starter motor 12 and oil pump 14, engine 10 is cranking at a low RPM rate while oil is being circulated throughout the moving parts of the engine. Upon actuation of fuel pump 16 and spark plug 18 at the end of the delay period, fuel and an ignition spark will be supplied to the engine cylinders and combustion will occur. In this manner, when the engine begins to turn over at higher rates, typically 1200 to 1500 RPM, the cylinders, pistons and other movable parts in the engine will be well lubricated, thereby reducing wear on these parts. The motion of the engine during the delay interval at the low cranking rate will not cause considerable friction or wear to the movable parts. Delay system 30 as described above is a fail safe system. If for any reason the relay fails, the engine will start normally without a delay.

It will be obvious to those reasonably skilled in the art that fuel pump 16 and/or spark plug 18 may be disconnected from battery 15 at any number of points throughout the electrical system of the engine while still obtaining the same results. The fuse point of the fuel pump and/or spark plug was chosen for its accessibility and ease of implementation when installing delay system 30 in engine 10.

Figure 3:
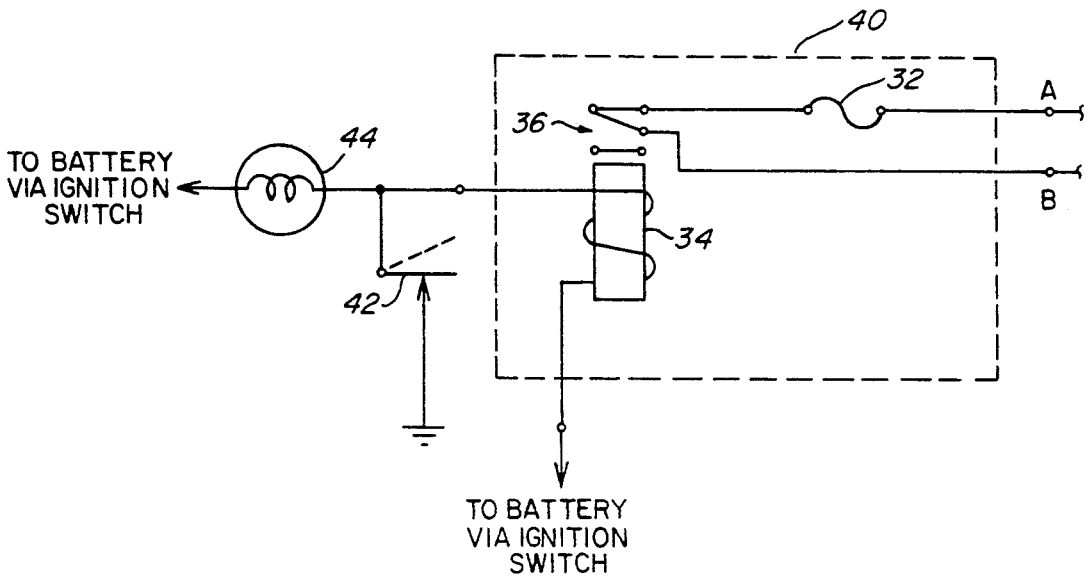
FIG. 3 is a schematic diagram of an engine wear prevention system in accordance with a third embodiment of the present invention.

A delay system 40 in accordance with a third embodiment of the present invention is illustrated in FIG. 3. Delay system 40 comprises fuse 32, relay coil 34, and relay contact 36, which coact with the oil pressure sensing switch 42, and oil pressure warning lamp 44 found in most internal combustion engines. Fuse 32 and relay contact 36 are coupled to nodes A-B similar to delay system 30. One end of relay coil 34 is coupled ignition switch 17. The other end of relay coil 34 is coupled to the output terminal of oil pressure sensing switch 42. Oil pressure sensing switch 42 is mounted to the engine block and senses the pressure of the engine oil circulating in the engine. Sensing switch 42 is normally closed. One teriminal of oil pressure warning lamp 44 is coupled to the output of sensing switch 42. The other terminal of lamp 44 is coupled to battery 15 through ignition switch 17.

Delay system 40, like delay system 30, operates automatically upon ignition of engine 10. When ignition switch 17 is closed, sensing switch 42 is closed, effectively coupling lamp 44 to ground. The opposite terminal of lamp 44 is connected to battery 15 through ignition 17 and is therefore illuminated, indicating inadequate oil pressure. In its closed position, oil pressure sensing switch 42 also couples one end of relay coil 34 to ground, activating coil 34 and causing contact 36, which is normally closed, to open, effectively disconnecting fuel pump 16 and/or spark plug 18 from battery 15.

Upon closing ignition switch 17, starter motor 12 and oil pump 14 are activated causing the slow turning of engine 10 to build up oil pressure. When the oil pressure reaches a predetermined level, the contact of pressure sensing oil switch 42 opens causing warning lamp 44 to go out and also deactivating relay coil 34. Upon deactivation of relay coil 34, relay contact 36 again returns to its normal closed position, thereby coupling fuel pump 16 and/or spark plug 18 to battery 15. In this manner, when the oil pressure reaches normal levels and the engine begins to fire and turn over at higher rates, the moving parts are well lubricated.

Figure 4:
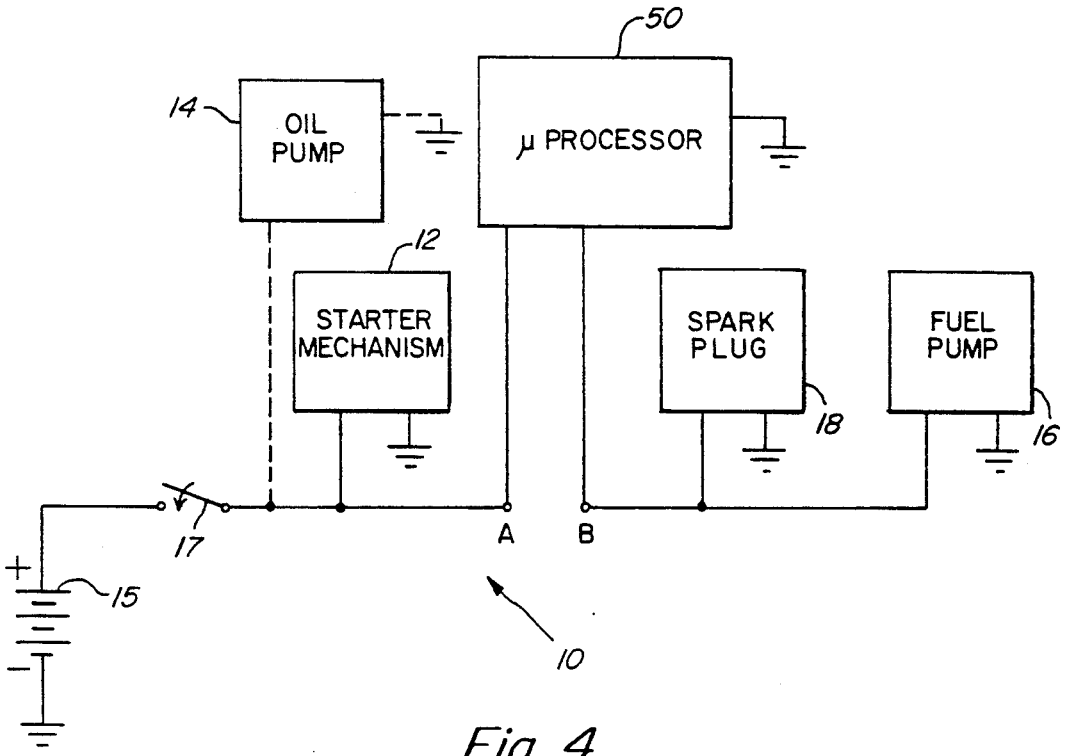
FIG. 4 is a schematic diagram of an engine wear prevention system in accordance with a fourth embodiment of the present invention.

According to a fourth embodiment to the present invention, the structures and functions of delay circuits 20, 30 and 40 may be replaced with a microprocessor 50 or other digital controller, as shown in FIG. 4. This embodiment is particularly advantageous for new automobiles which are manufactured with microprocessor controllers. The microprocessor can control the actuation of starter motor 12 and oil pump 14 as well as function as a timer for a predetermined time interval before actuating fuel pump 16 and spark plugs 18. In this manner, the microprocessor can function similar to delay system 30. In a similar manner, the microprocessor can be coupled to an oil pressure sensing switch, similar to switch 44, and can actuate starter motor 12 and oil pump 14, and, when detecting normal oil pressure, actuate fuel pump 16 and spark plugs 18. In this manner, the microprocessor performs the same functions as delay circuit 40.

In alternate embodiments to delay system 40, oil pressure sensing switch 42 may be replaced with a temperature sensing switch a temperature sensor, which monitors either the temperature of the engine oil, water or engine block, which may be schematically represented similar to sensing switch 42 in FIG. 3. The temperature sensor, which is normally in a closed position, will open when the proper temperature is sensed, i.e., the engine and/or fluids are still warm. The opening of the temperature sensing switch prevents relay coil 34 from being connected to ground thereby preventing the coil from becoming energized. If the coil is not energized, its corresponding relay contact 36 will remain closed and the fuel pump 16 and/or spark plugs 18 will remain connected to the battery 15 allowing the engine to start normally without any delay in combustion. In this manner, while the engine is still warm and there is still sufficient residual oil lubricating the parts of the engine, the function of the delay system may be overridden. As such; the delay system will operate only on "cold starts" when the engine is cold and not lubricated, thereby reducing wear on the battery 15 and starter mechanism 12.

The delay systems of the present invention may be packed in a kit form which includes all necessary system components and installation instructions for ease of installation in existing vehicles. The kit may further include a plurality of standard size dummy fuses for coupling the delay system to the engine circuit.

Accordingly, it will be appreciated that the detailed description has been presented by way of example only and is not intended to be limiting. Various alterations, modifications and improvements will readily occur to those skilled in the art, and may be practiced without departing from the spirit and scope of the invention. The invention is limited only as required by the following claims and equivalents thereto.

What is claimed is:

1. A method for preventing wear in an internal combustion engine having a plurality of movable parts, a starter mechanism for cranking the engine thereby initiating movement of the parts, an oil supply system having an oil pump for circulating oil to the movable parts, a fuel pump for supplying a combustible fuel to the engine, and an ignition means for igniting the combustible fuel, the method comprising the steps of:

a. actuating the starter mechanism to initiate movement of the plurality of movable parts;

b. actuating the oil pump to circulate oil to the movable parts; and c. preventing delivery of fuel to the engine from the fuel pump while the oil pump and starter mechanism are actuated and until a predetermined condition occurs wherein the engine is adequately prelubricated.

2. The method of claim 1 wherein step (c) further comprises preventing the fuel from being ignited.

3. The method of claim 2 wherein step (c) further comprises preventing the ignition means from being actuated.

4. The method of claim 1 wherein said predetermined condition comprises the elapsing of a predetermined time interval.

5. The method of claim 1 wherein said predetermined condition comprises the pressure in the oil supply system reaching a predetermined level.

6. A method for preventing wear in an internal combustion engine having a plurality of movable parts, a starter mechanism for initiating movement of the parts, an oil supply system having an oil pump for circulating oil to the movable parts, a fuel pump for supplying a combustible fuel to the engine, and an ignition means for igniting the combustible fuel, the method comprising the steps of:

a. actuating the starter mechanism to initiate movement of the plurality of movable parts;

b. actuating the oil pump to circulate oil to the movable parts;

c. preventing combustion of the fuel while the oil pump and starter mechanism are actuated and until a predetermined condition occurs; and d. determining whether the movable parts of the engine are adequately lubricated before actuating the starter mechanism and the oil pump.

7. The method of claim 6 wherein step (d) comprises sensing the temperature of the engine.

8. The method of claim 6 wherein step (d) comprises sensing the temperature of the oil within the oil supply system.

9. The method of claim 6 wherein step (d) further comprises sensing the temperature of the engine block.

10. A method for reducing wear in the firing chamber of an internal combustion engine having a piston means moving in said chamber and at an initial low cranking speed and a subsequent higher operating speed, said piston means and firing chamber being subject to wear over a sliding surface of said chamber at a movable intersection of said chamber and said piston means, said method comprising:

providing a lubricating oil to said sliding surface when said piston means is moving at said cranking speed while preventing firing or combustion of fuel in said chamber for a predetermined time sufficient to substantially reduce wear in the firing chamber.

11. A kit comprising an apparatus for preventing wear in an internal combustion engine having a starter motor, an oil pump, a fuel pump, an ignition means and an electrical system for actuating the starter motor and oil pump, said apparatus comprising:

a delay element designed and constructed for preventing actuation of one or both of the fuel pump and ignition means while the starter motor cranks the engine and oil pump is actuated and until a predetermined condition occurs such that the engine is adequately prelubricated and wear is prevented in the internal combustion engine when the fuel pump and ignition means are operative.

12. A kit in accordance with claim 11 and further comprising a low amperage fuse for interconnection with said delay element.

13. A kit in accordance with claim 11 and further comprising instructions for using and installing said apparatus.

14. A kit in accordance with claim 11 wherein said predetermined condition comprises the elapsing of a predetermined time interval.

15. A kit in accordance with claim 11 wherein said predetermined condition comprises the pressure at the oil pump reaching a predetermined level.

16. In an internal combustion engine having a plurality of movable parts capable of moving at an initial low cranking speed and a subsequent higher operating speed, a starter mechanism for cranking the engine thereby initiating movement of the parts, an oil supply system having an oil pump for circulating oil to the movable parts, a fuel pump for supplying fuel to the engine, and an ignition means for igniting the fuel within the engine, the improvement comprising:

means for actuating the starter mechanism and oil pump; and programmable logic means, coupled to at least one of the fuel pump and ignition means, for preventing combustion of the fuel while the starter mechanism and oil pump are actuated and while said plurality of parts are moving at cranking speed and until a predetermined condition occurs wherein the engine is adequately prelubricated.

17. In an internal combustion engine the improvement according to claim 16 wherein said programmable logic means comprises a microprocessor programmed to prevent delivery of fuel to the engine.

18. In an internal combustion engine the improvement according to claim 16 wherein said programmable logic means comprises a microprocessor programmed to prevent actuation of the ignition means.

19. In an internal combustion engine the improvement according to claim 16 wherein said predetermined condition comprises the elapsing of a predetermined time interval.

20. In an internal combustion engine having a plurality of moving parts, a starter mechanism for initiating movement of the parts, an oil supply system having an oil pump for circulating oil to the movable parts, a fuel pump for supplying fuel to the engine, and an ignition means for igniting the fuel within the engine, the improvement comprising:

means for actuating the starter mechanism and oil pump; and means for preventing combustion of the fuel while the starter mechanism and oil pump are actuated and until the pressure in the oil supply system reaches a predetermined level.

21. A method of using a combustion prevention apparatus for preventing wear in an internal combustion engine, the engine having a plurality of movable parts capable of moving at an initial low cranking speed and a subsequent higher operating speed, an oil supply system for circulating oil to the movable parts, a fuel supply system for delivering fuel to the engine, and an ignition element for igniting the fuel within the engine, the prevention apparatus comprising a cut-off element coupled to the engine and at least one of the fuel supply system and the ignition element for selectively uncoupling at least one of the fuel supply system and ignition element from the engine while the engine is cranking, the method comprising the steps of:

actuating the cut-off element; and uncoupling at least one of the fuel supply system and ignition element from the engine, while the plurality of movable parts are moving at said cranking speed and the oil supply system is circulating oil to said movable parts, for a predetermined period of time sufficient to prevent wear in the engine.

22. The method of claim 21 wherein said predetermined period of time is at least approximately three seconds.

23. The method of claim 21 wherein the step of uncoupling comprises uncoupling both the fuel supply system and ignition element from the engine.

* * * * *